US008019207B2

(12) United States Patent
Zhou

(10) Patent No.: US 8,019,207 B2
(45) Date of Patent: Sep. 13, 2011

(54) FLAME SIMULATOR OF ELECTRIC FIREPLACE

(76) Inventor: Jun Zhou, Shanghai (CN)

( * ) Notice: Subject to any disclaimer, the term of this patent is extended or adjusted under 35 U.S.C. 154(b) by 305 days.

(21) Appl. No.: 12/159,961

(22) PCT Filed: Feb. 5, 2007

(86) PCT No.: PCT/CN2007/000377
§ 371 (c)(1),
(2), (4) Date: Oct. 13, 2008

(87) PCT Pub. No.: WO2007/090340
PCT Pub. Date: Aug. 16, 2007

(65) Prior Publication Data

US 2009/0220221 A1 Sep. 3, 2009

(30) Foreign Application Priority Data

Sep. 2, 2006 (CN) ..... 2006 2 0039415 U

(51) Int. Cl.
*F24B 1/18* (2006.01)

(52) U.S. Cl. ..... 392/348; 392/347

(58) Field of Classification Search ..... 392/347, 392/348
See application file for complete search history.

(56) References Cited

U.S. PATENT DOCUMENTS 3,699,697 A * 10/1972 Painton ..... 40/428
4,965,707 A * 10/1990 Butterfield ..... 362/96
5,642,580 A 7/1997 Hess et al.
6,047,489 A * 4/2000 Hess et al. ..... 40/428
6,363,636 B1 * 4/2002 Hess et al. ..... 40/428
6,393,207 B1 5/2002 Martin et al.
7,080,472 B2 * 7/2006 Schroeter et al. ..... 40/428
7,162,820 B2 1/2007 Hess et al.
2002/0095832 A1 7/2002 Hess et al.
2005/0086841 A1 4/2005 Schroeter et al.
2005/0097793 A1 5/2005 Hess
2005/0252051 A1 11/2005 Chen

FOREIGN PATENT DOCUMENTS

CN 02148092.3 4/2003

* cited by examiner

*Primary Examiner* — Thor Campbell
(74) *Attorney, Agent, or Firm* — Paul Y. Feng; The Eclipse Group LLP

(57) ABSTRACT

An apparatus for flame simulation in an electrical fireplace which improves the realism of leaping and flickering flames, comprising a fixed light source, simulated charcoal, and a flame display screen which is arranged above the fixed light source. The simulated charcoal is located in front of the flame display screen. A twisted-style light reflector is located behind the flame display screen and is driven by a motor mounted inside the wall of the electrical fireplace. By rotating the twisted-style light reflector, light emitted from the fixed light source is reflected onto the flame display screen so the simulated dynamic leaping and flickering flames can be seen. The fixed light source also illuminates the simulated charcoal to produce an effect of burning charcoals. A heater produces warm air that is expelled from the fireplace.

12 Claims, 3 Drawing Sheets

FLAME SIMULATOR OF ELECTRIC FIREPLACE

CLAIM OF FOREIGN PRIORITY

This application is the U.S. national phase under 35 U.S.C. §371 of International Application No. PCT/CN2007/000377, filed Feb. 5, 2007, which claims priority to Chinese Patent Application No. 200620039415.0, filed Feb. 9, 2006, all of whose contents are hereby incorporated by reference in their entirety.

BACKGROUND OF THE INVENTION

The present invention relates to a flame simulation apparatus, and more particularly, to a flame simulation apparatus for an electrical fireplace.

One type of currently existing flame simulation apparatus for an electrical fireplace simulates a burning medium resembling coal, charcoal, or branch-shaped firewood. The actual burning medium is replaced by a plastic casing coated with branch-like wood color on its surface and a light source installed therein to simulate the effects of burning branches or coal. Furthermore, a cluster of flame-shape silk ribbons is hung above the simulated burning medium, which flutters by ambient blowing air or driven by an electric fan. The projection effect of the fluttering ribbons generates a vision or aura of a flickering flame which can be seen through a semi-transparent plastic screen and a mirror glass. Such an apparatus can simulate the visual effect of flickering flames. However, its disadvantage is that the generated flame appearance lacks brightness and transparency of actual flames, and there is no leaping and rising phenomena of real burning flames.

Another type of apparatus has a rotating-shaft-coupling optical reflector or a translucent lamp shade of various shapes, driven by a motor, installed behind the branch-shape, charcoal-like burning medium. The mechanism for the rotating-shaft-coupling optical reflector is an optical reflector mounted onto a rotating shaft and the illusion of flames is generated by reflecting the external light source.

The mechanism for a rotating shaft to drive the translucent lamp shade and transmit light is an internal light passing through an abnormally-shaped apertures of the translucent lamp shade. The translucent lamp shade has a flame-shape wall template to model the flame. The latter is projected onto a semi-transparent screen and a mirror glass which give a simulated flame rising effect.

A cylindrical curved-surface of the hollow translucent lamp shade uses the curved surface of the casing to model the pattern of the flame. The flame simulated by this so-called "rotating-blade-type reflection flame or translucent lamp shade of various shapes" shows the enhanced brightness and gives leaping flame impression. However, its disadvantage is that the effect of leaping flames is rather repetitive and lacking in natural grace as compared to real flickering flames. This is due to the repetitive and uniform modeling of the flame by the flame-shape wall template of the device. As a result, the overall visual effect of the flame simulated by such an arrangement is that it has an artistic impression but lacks a natural, randomized, lifelike effect.

Chinese Patent Application No. CN 01113160.8 discloses an apparatus for simulating flame in an electrical heater. Its characteristic is that the dynamic light source is a hollow cylindrical translucent lamp shade with an illuminating lamp, and has apertures formed on its surface. The translucent lamp shade and the illuminating lamp are paired together and connected to a motor that rotates them via a transmission mechanism. Such a flame simulation apparatus for an electrical fireplace could eliminate the flame-shape wall template to rigidly model actual flames and give a visual effect of rising and leaping flames. However, its disadvantage is that the flame leaping is not natural and graceful enough, again lacking a randomized, lifelike effect.

Chinese Patent Application Publication No. CN 2708144Y discloses an apparatus for simulating flame in an electrical fireplace, which has a moving light source, a semi-transparent imaging screen and a semi-transparent mirror glass (screen). The moving light source is positioned behind the imaging screen and the mirror glass is fixed in front of the screen. The moving light source consists of a casing with flame-shaped apertures, a light source and a motor, wherein the light source is located inside the casing, and the casing is driven by the motor to rotate. The light source emits light while the motor drives the casing to rotate. The light passes through a plurality of flame shape apertures in the rotating casing surface, which surface forms multiple curved-surface dynamic light sources that are orderly arranged at various heights and in different angles. These light sources are then projected onto the semi-transparent filter screen and an illusion of rising and leaping of burning flame can be seen through the mirror glass. The disadvantage of such apparatus also lies in that the simulated flames are not natural and graceful, and further lack a randomized, lifelike effect.

SUMMARY OF THE INVENTION

The present invention is directed to a flame simulator for an electrical fireplace, which simulator generates visual effects of leaping and rising phenomena of real burning flames, and further improves on the randomized, lifelikeness of the simulated flame. The present invention therefore overcomes the technical disadvantages mentioned above.

In one embodiment of the present invention, the flame simulation apparatus for an electrical fireplace includes a fixed light source, a simulated charcoal and a flame display screen which are fixed above the light source. Specifically, the simulated charcoal is located in front of the flame display screen, wherein a twisted-style light reflector is driven by a motor mounted on the wall of the electrical fireplace, and is positioned behind the flame display screen.

By rotating the twisted-style light reflector, the light emitted from the fixed light source is reflected on the flame display screen, which produces an convincing illusion of the leaping and burning phenomena of a dynamic flame. Concurrently, the fixed light source also illuminates the simulated charcoal to produce an effect of burning charcoals.

In order to increase the flickering effect of the flame, an optional flame brightness switch is installed on the electrical fireplace to control the light intensity of the fixed light source.

In one embodiment, the twisted-style light reflector includes a rotating shaft and individual optical reflector elements. The individual optical reflectors may have various shapes and sizes, and begin as flat strips. The shaft is preferably made from a single strand of wire doubled over and twisted together, wherein the individual reflectors are pinched and caught in the twisted wires and splayed around the axis of the shaft. As a result of the incidental arrangement of light reflectors and the twisted connection to the shaft, the reflectors have varying shapes, tilt angles of attachment to the shaft, locations along the shaft, and the like. The twisting in the wire also distorts the formerly flat reflector into varying cupped shapes. The individual reflectors thus have very different appearances relative to one another.

As a result of the above arrangement, while the twisted-style light reflector is rotating, the distances between the reflected light spots and their brightness, the shape and the rising speed of each spot, all change following the variation of the height, the reflection angle, the tilted position, and cupped shape of each reflector. So a continuously rising light formed by a plurality of randomized light spots of differing intensities gives a more realistic illusion of a natural flame on the display screen. Such a simulated flame rises and flickers, and varies its visual patterns in simulating fire.

In various alternative embodiments, the color of the optical reflector can be the color of natural flame, such as tawny. The fixed light source may be an ordinary bulb, a fluorescent tube lamp, or a halogen lamp. The number of the lamps to be used for the light source may be one, or may be more than one to form a plurality of fixed light sources.

The flame display screen may be any kind of filter screen or imaging device, such as a semi-transparent or translucent filter screen or a tawny glass block/plate whose surface has been modified by spray coating and printing process. The filter screen may be made of any kind of organic or inorganic material, such as organic glass and the like. The simulated charcoal is preferably a plastic object that simulates a charcoal block.

In the preferred embodiment of the present invention, the appearance of the flame inside the electrical fireplace is simulated entirely by the fixed light source. The apparatus for flame simulation in an electrical fireplace includes a fixed light source, simulated charcoal, a twisted-style light reflector arrangement and a flame display screen. Using the special optical effect created by the fixed light source on the simulated charcoal and the twisted-style light reflector, the dynamic pattern of the flame can be more realistically simulated. The apparatus for flame simulation in an electrical fireplace presented here can simulate a flame with lifelike leaping effect, and the pattern of the simulated flame closely resembles a real flame.

Under the control of electronics, the brightness of the flame pattern and the operation state of the electrical fireplace can be adjusted by a user in accordance with the desired simulated flame effect. A heater may be include to increase ambient temperature. The present invention thus combines artistic enjoyment of an electrical fireplace with a heating function.

DETAILED DESCRIPTION OF THE PREFERRED EMBODIMENTS

The present invention in various embodiments will now be described in detail with reference to the accompanying figures.

Figure 1:
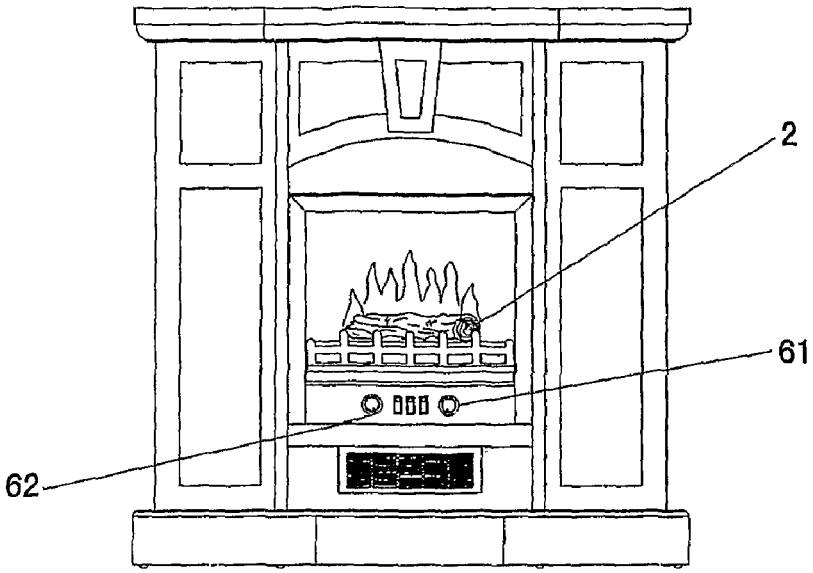
FIG. 1 is a front elevational view of the electrical fireplace and the apparatus for flame simulation in an electrical fireplace according to the present invention.
Figure 2:
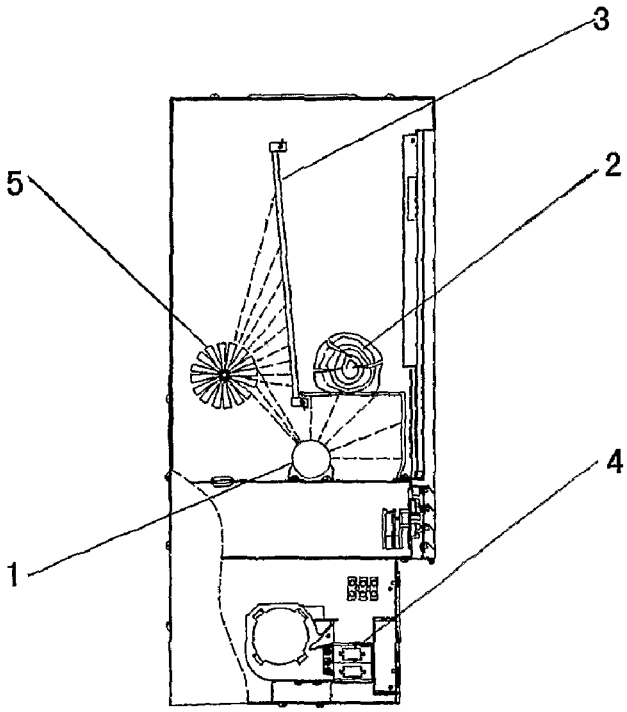
FIG. 2 is a side elevational view of the apparatus for flame simulation in an electrical fireplace according to the present invention, showing the paths of light inside the electrical fireplace.
Figure 3:
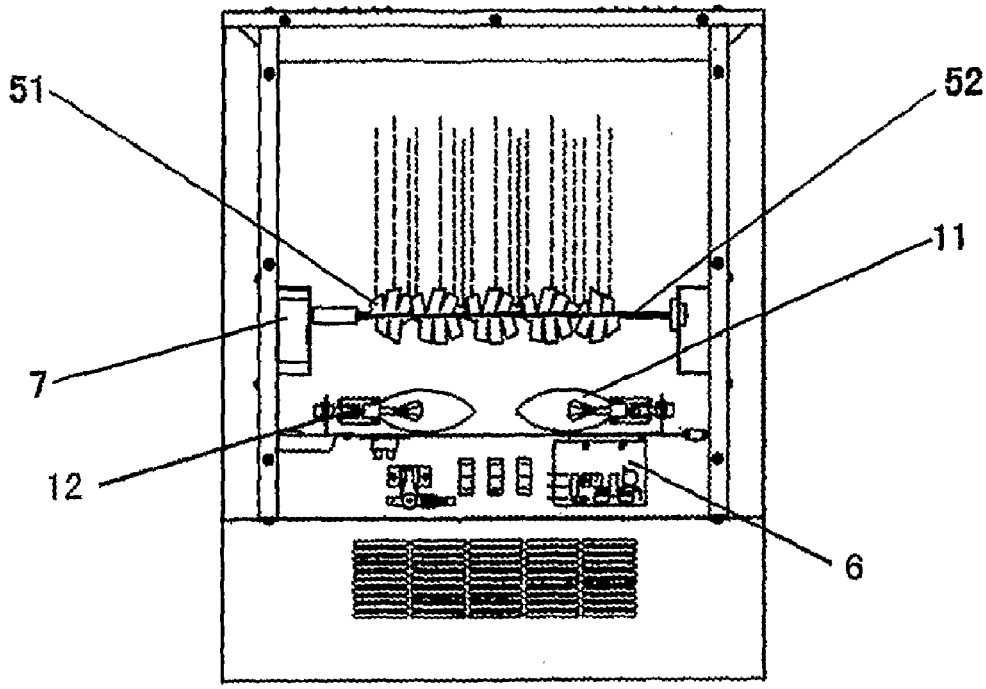
FIG. 3 is a rear elevational view of the apparatus for flame simulation in an electrical fireplace according to the present invention, showing the paths of the reflected light inside the electrical fireplace.

Referring to FIG. 1 and FIG. 2, a flame simulation apparatus for an electrical fireplace according to one preferred embodiment of present invention includes a fixed light source 1, simulated wood log, charcoal, or burning medium 2, and a flame display screen 3 which are located above the fixed light source 1. An optional heater 4 is located below the fixed light source 1. A twisting-style light reflector 5 is arranged behind the simulated charcoal 2 and the flame display screen 3. In FIG. 3, an electronic control circuit 6 is placed near the front panel of the electrical fireplace, and is used for controlling the brightness of the fixed light source 1 as well as the temperature of the heater 4.

As seen in FIG. 3, the fixed light source 1 is fixed in that it is not moved by a motor or other actuation source, and remains in place during operation of the fireplace. The fixed light source 1 preferably includes two ordinary incandescent light bulbs 11, 12. The fixed light source 1 can also be a fluorescent tube lamp, or a high intensity halogen lamp. The lamps or bulbs may be of different colors. The number of the lamps employed by the fixed light source 1 may be a single bulb or multiple bulbs.

The flame display filter screen 3 may be any kind of filter screen or imaging device, such as a semi-transparent filter screen or a tawny glass plate whose surface has been modified by spray coating and printing process. The filter screen 3 may be made of any kind of organic or inorganic materials, such as organic glass and the like. The simulated charcoal 2 is preferably a simulated plastic charcoal chunk manufactured by plastic molding process. The surface of the simulated charcoal 2 has irregular and uneven shapes, which resemble the surface of a natural charcoal block. Under the illumination of the light reflected from the optical reflectors 51, the appearance is a natural, bright red color of burning charcoals.

Figure 4:
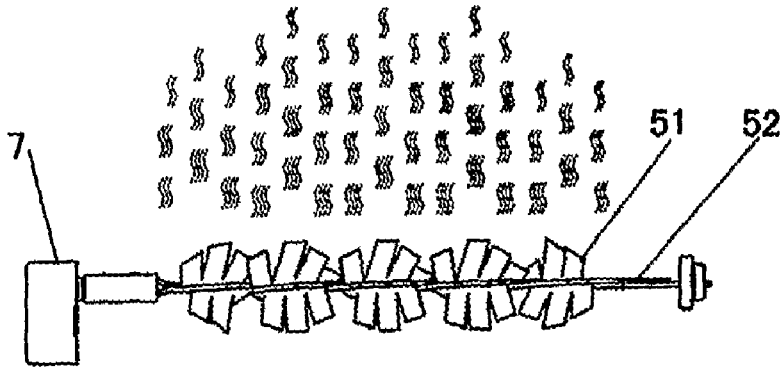
FIG. 4 shows in a schematic drawing the twisted-style light reflector and the pattern of the reflected light spots within the apparatus for flame simulation in an electrical fireplace according to the present invention.

With reference to FIG. 4, the preferred embodiment twisted-style light reflector 5 includes a plurality of individual elements or optical reflectors 51 mounted to a rotating shaft 52. As best seen in the perspective view of FIG. 5, the optical reflectors 51 start out as small, flat, reflective strips. The shaft 52 is preferably made from a single strand of metal wire bent over and twisted against itself into a long helix. Between the twists of the wire, the optical reflectors 51 are pinched and captured therein, and thus affixed to the shaft 52. Gluing, soldering, or welding may be used to further affix the individual optical reflectors 51 to the shaft 52.

Figure 5:
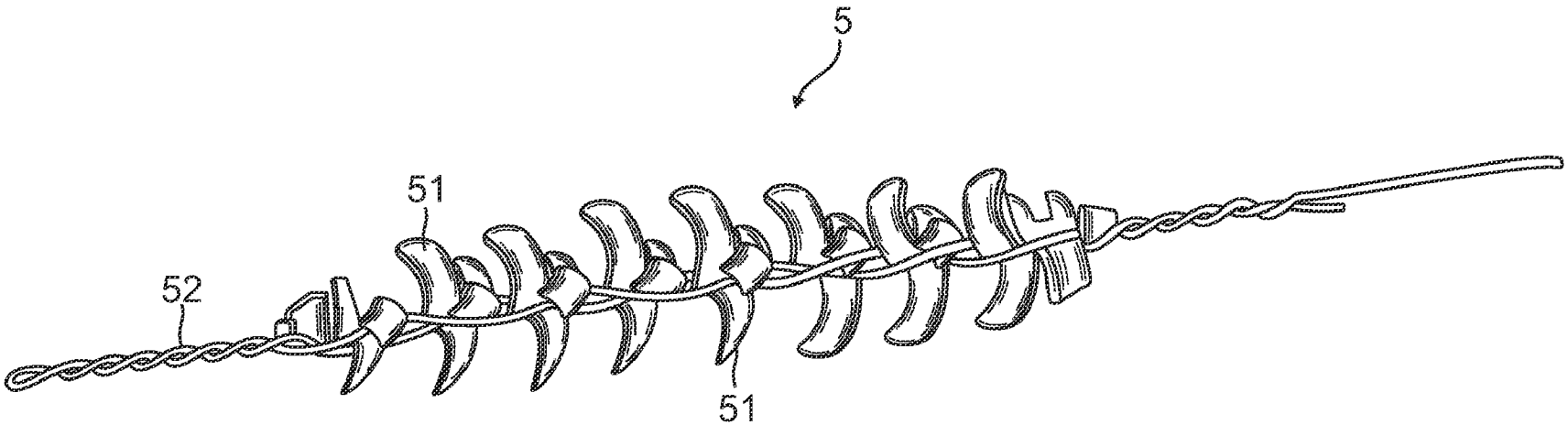
FIG. 5 is a detailed perspective view of the twisted wire with individual light reflector elements.

The reflective elements may be made from thin, pliable strips of aluminum or polished stainless steel. As the strips are twisted into the shaft 52, the twisting action bends, distorts, and plastically deforms the shapes of the strips. As seen in FIG. 5, the strips become bowed, curved, and cupped to varying degrees due to the twisting action. The size, shape, tilt angle, curvature, and cupping of the individual optical reflectors 51 are fairly irregular and randomized due to the amount of distortion worked into the material by the twisting action. How the optical reflectors 51 are splayed radially outward from the shaft 52 may be further adjusted by manually bending and twisting the strips, and gaps along the shaft may be included between the optical reflectors 51. The irregular depth, curvature, and sizes of the cupped shapes of the optical reflectors 51 further change the intensity, size, shape, direction, and appearance of the reflected light to further enhance a flame flickering effect projected on to the flame display filter screen 3.

Advantageously, the twisting action used to simultaneously form the shaft 52 and mount the optical reflectors 51 is highly efficient, cost effective, and benefits from ease of manufacture. The resulting optical reflector arrangement produces fairly randomized light patterns to improve the illusion of an actual flickering flame. The strips may optionally be made in the color of flame, such as red and tawny.

The twisted-style light reflector 5 is driven by a motor 7 to rotate about its axis. Due to the somewhat randomized variation of the height, reflection angle, surface curvature, shape, tilted position, reflector location, of each individual optical reflector 51, when light is reflected off of the reflector surfaces as the shaft is rotated, there is a constant change in the distances between the reflected light spots, and the brightness, shape, size, and rising speed of the light spots. As seen in FIG. 3, under the simulation effects of the flame display screen 3 and simulated charcoal 2, the combination of a plurality of rising light spots of differing brightness, shape, size, and rising speed, gives a compelling illusion of rising, leaping, and flickering flames of a real burning fire.

In addition, optional heater 4 is mounted in either the lower or the upper portion of the electrical fireplace. The temperature control switch 61 mounted at a front panel operates the control circuit 6, which controls the heater 4 so that it can be activated to blow heated or warm air through an air outlet near the bottom of the electrical fireplace. Furthermore, there is a flame brightness switch 62, such as a potentiometer, on the control circuit 6 for controlling the brightness of the light source 1. The heater, motor, electronic circuits, and control switches used with the electric fireplace can be commonly found off-the-shelf devices.

The housing and façade of the electrical fireplace simulate a real fireplace. The housing and façade may be made of wood, plastic, metal, brick, ceramic, glass, and the like, as needed.

To operate the electrical fireplace, a user turns the switch 62 to power on the electrical fireplace. The bulbs 11, 12 are powered up and they illuminate the simulated charcoal 2, which gives off a bright red appearance of a burning charcoal fire. Meanwhile, the optical reflectors 51 are rotated twisted wire shaft 52, which is driven by the motor 7. The rotating optical reflectors 51 reflect the light emitted by the bulbs 11, 12 and generate dynamic, rising light spots on the back of flame display screen 3. Consequently, a simulated burning flame can be viewed on the front side of flame display screen 3 of the fireplace. The brightness of the simulated flame can be controlled by adjusting the flame brightness switch 62. If the temperature control switch 61 is turned on, the heater 4 produces warm air, pushing that warm air through an air vent.

Those skilled in this field will appreciate that numerous modifications and variations may be made to the above disclosed embodiments to achieve the same objective of the present invention, without departing from the spirit and scope of the invention as defined in the following claims.

What is claimed is:

1. An apparatus for flame simulation in an electrical fireplace having a front, comprising:

a fixed light source;

a simulated charcoal and a flame display screen arranged above the fixed light source, wherein the simulated charcoal is located in front of the flame display screen toward the front of the fireplace;

a light reflector disposed behind the flame display screen reflecting light from the fixed light source onto the flame display screen, wherein the light reflector includes a twisted wire shaft with a plurality of individual reflector elements captured in the twisted shaft, and wherein the reflector elements have curved and cupped shapes; and a motor rotating the shaft.

2. The apparatus for flame simulation in an electrical fireplace according to claim 1, wherein a flame brightness switch is installed on the electrical fireplace to control the light intensity of the fixed light source.

3. The apparatus for flame simulation in an electrical fireplace according to claim 1, wherein the reflector elements are distorted to have irregular shapes, sizes, and curvatures.

4. The apparatus for flame simulation in an electrical fireplace according to claim 1, wherein the reflector elements are splayed radially along the shaft.

5. The apparatus for flame simulation in an electrical fireplace according to claim 1, wherein the fixed light source includes at least one of an incandescent bulb, a fluorescent tube lamp, and a halogen lamp.

6. The apparatus for flame simulation in an electrical fireplace according to claim 1, wherein there is a plurality of lamps.

7. The apparatus for flame simulation in an electrical fireplace according to claim 1, wherein the flame display screen includes at least one of a semi-transparent filter screen and a tawny glass block/plate which surface has been modified by spray coating and printing.

8. The apparatus for flame simulation in an electrical fireplace according to claim 1, wherein the simulated charcoal includes a plastic charcoal block.

9. An apparatus for flame simulation in an electrical fireplace having a front, comprising:

a simulated burning medium facing the front of the fireplace made of a translucent material;

a flame display screen disposed behind the simulated burning medium;

a light reflector disposed behind the flame display screen, wherein the light reflector includes a twisted wire shaft with a plurality of individual reflector elements captured in the twisted shaft, and wherein the reflector elements are curved and cupped;

an electric motor rotating the wire shaft;

a fixed light source underneath the simulated burning medium and the light reflector; and wherein the light from the fixed light source reflected by the plurality of reflector elements is projected onto the flame display screen to simulate a flickering flame, and the light from the fixed light source illuminates the simulated burning medium.

10. The apparatus for flame simulation in an electrical fireplace according to claim 9, wherein the fireplace includes a heater to generate heated air.

11. An apparatus for flame simulation in an electrical fireplace having a front, comprising:

a simulated burning medium facing the front of the fireplace made of a translucent material;

a flame display screen disposed adjacent the simulated burning medium;

a light reflector disposed adjacent the flame display screen, wherein the light reflector includes a single strand wire shaft bent over and twisted into a helix, and wherein a plurality of individual reflector elements are captured in the twisted shaft, and wherein the reflector elements are distorted into irregular curved and cupped shapes;

an electric motor rotating the wire shaft;

a fixed light source projecting light into the simulated burning medium and the light reflector;

a heater generating and expelling heated air from the fireplace; and wherein the light from the fixed light source reflected by the plurality of reflector elements is projected onto the flame display screen to simulate a flickering flame.

12. The apparatus for flame simulation in an electrical fireplace according to claim 11, wherein the reflector elements have varying and irregular shapes.

* * * * *